US007654873B2

(12) United States Patent
Luo et al.

(10) Patent No.: US 7,654,873 B2
(45) Date of Patent: Feb. 2, 2010

(54) ELECTRICAL CONNECTOR PROVIDED WITH ALIGNMENT SLOT

(75) Inventors: Yu Luo, ShenZhen (CN); Wei Yuan, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/214,965

(22) Filed: Jun. 23, 2008

(65) Prior Publication Data

US 2008/0318444 A1 Dec. 25, 2008

(30) Foreign Application Priority Data

Jun. 21, 2007 (CN) ..... 2007 2 0038755

(51) Int. Cl.
*H01R 13/514* (2006.01)

(52) U.S. Cl. ..... 439/731; 439/638; 439/904

(58) Field of Classification Search ..... 439/638, 439/731, 904

See application file for complete search history.

(56) References Cited

U.S. PATENT DOCUMENTS 6,331,122 B1 * 12/2001 Wu ..... 439/567
6,832,934 B1 * 12/2004 Zhang ..... 439/660
6,887,108 B2 * 5/2005 Wu ..... 439/638
6,942,524 B2 * 9/2005 Wu ..... 439/637

FOREIGN PATENT DOCUMENTS

CN 2541966 3/2003

* cited by examiner

*Primary Examiner*—Truc T Nguyen
(74) *Attorney, Agent, or Firm*—Wei Te Chung; Andrew C. Cheng; Ming Chieh Chang

(57) ABSTRACT

An electrical connector includes a mating portion including a first cavity (13) and a second cavity (11) divided by a partition (17). The first cavity (13) is structurally different from the second cavity (11), the first cavity (13) being of an L shape including a vertical alignment part (15) positioned proximate to the partition (17), while the second cavity (11) has no vertical alignment slot, which is removed to make the insulative housing (10) to have a greatly-reduced lateral dimension thereof so as to mount the insulative housing (10) onto a limited space of a printed circuit board.

19 Claims, 4 Drawing Sheets

ELECTRICAL CONNECTOR PROVIDED WITH ALIGNMENT SLOT

BACKGROUND OF THE INVENTION

1. Field of the Invention

The present invention relates to the art of electrical connectors, and more particularly to an electrical connector provided with an alignment slot such that the connector and a complementary connector are inhibited from engaging one another if one of them is reversed upside down relative to the other.

2. Description of the Related Art

Chinese Pat. Issue No. 2541966 issued on Mar. 12, 2003 discloses a related electrical connector generally named as Serial ATA Conn. The electrical connector includes a mating portion having first and second parts divided by a partition. Each of the first and second parts includes a cavity being of an L-shape, with each of the cavities including a vertical alignment slot disposed proximate to the partition. The two vertical alignment slots are set such that two mated connectors are inhibited from engaging one another if one of them is reversed upside down relative to the other. Other related connectors including the two vertical alignment slots are found in TW Pat. Issue No. 257195, TW Pat. Issue No. 271277, TW Pat. Issue No. 300879, TW Pat. Issue No. 307889 and TW Pat. Issue No. 551631.

With the trend of miniaturization, the connectors are required to have a greatly-reduced lateral dimension of an insulative body so as to be mounted on a limited space of the printed circuit board. A problem, however, with the above-described electrical connector is that the mating portion is set to have two alignment slots, which really occupies the lateral scale of the insulative body. Therefore, there is a need to provide a new connector to resolve the above-mentioned problem.

SUMMARY OF THE INVENTION

An electrical connector according to an embodiment of the present invention includes an insulative housing defining a forwardly protruding mating portion with a front face and an opposite back face, the mating portion having first and second parts divided by a partition. The first part has a first cavity extending from the front face toward the back face and structurally different from a second cavity defined on the second part, such that the partition has opposite sides formed asymmetrical about a cross-sectional center of the partition. A plurality of passageways extends therethrough from the front face to the back face and is disposed along a transverse edge of each of the first and second cavities, the passageways adapted to communicate with the corresponding one of the first and second cavities. A plurality of terminals inserted into the passageways in a direction from the back face to the front face of the mating portion. The first cavity is of an L shape including a vertical alignment slot disposed proximate to the partition, while the second cavity merely includes a horizontal slot with no vertical alignment slot, which is removed to make the insulative housing to have a greatly-reduced lateral dimension thereof so as to mount the insulative housing onto a limited space of a printed circuit board.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
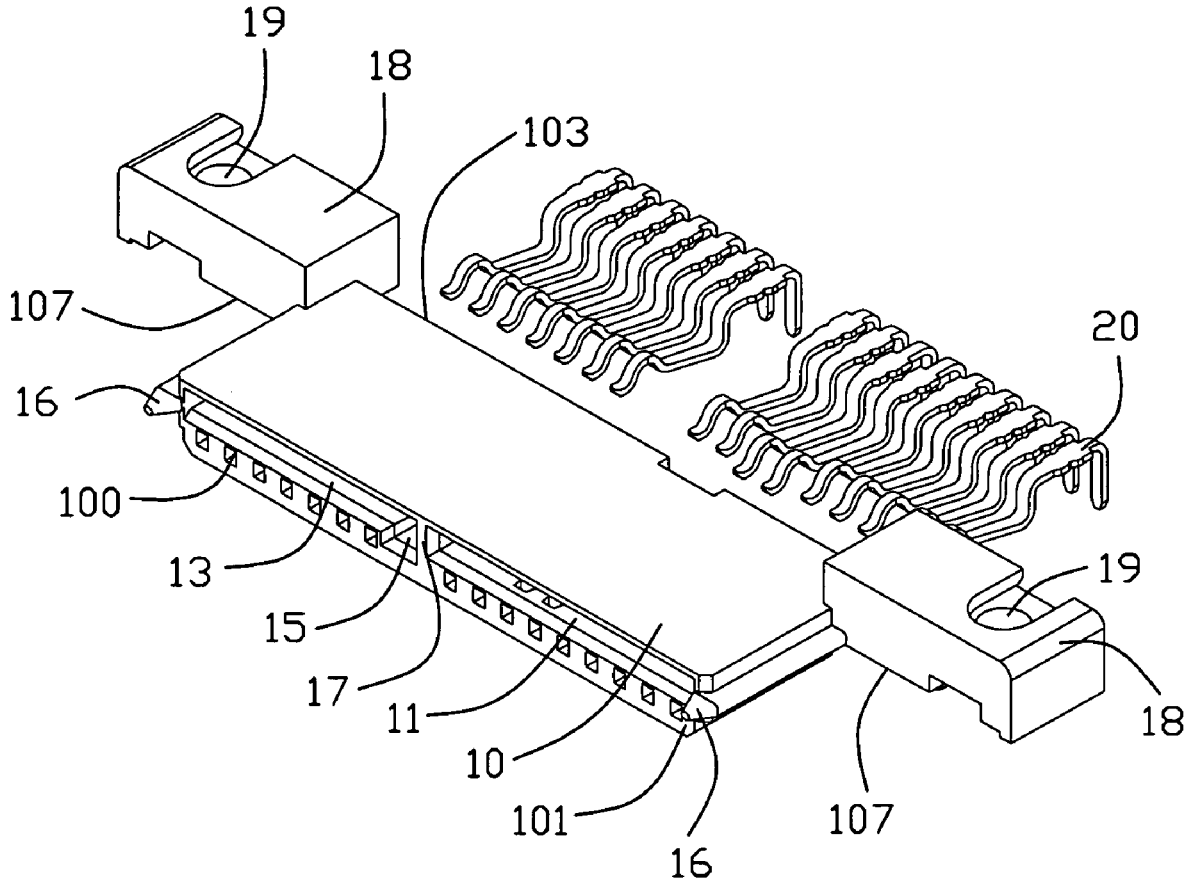
FIG. 1 is an exploded, perspective view of the electrical connector according to an embodiment of the present invention.
Figure 2:
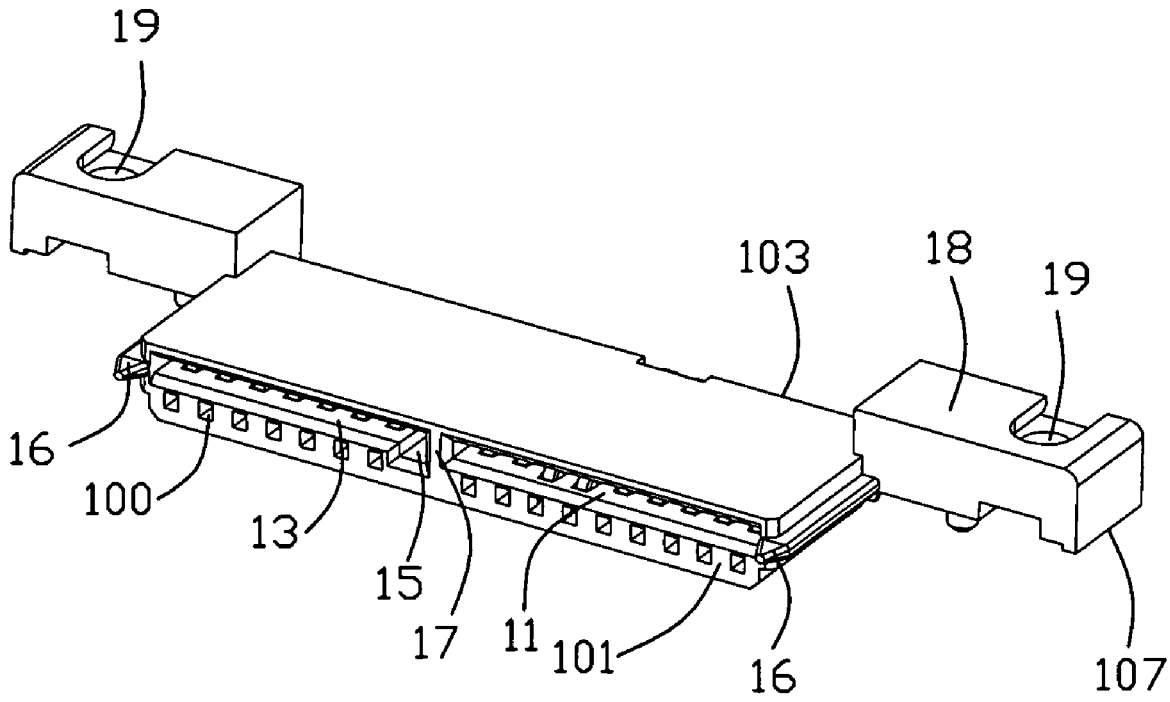
FIG. 2 is an assembled, perspective view of the electrical connector of FIG. 1.
Figure 3:
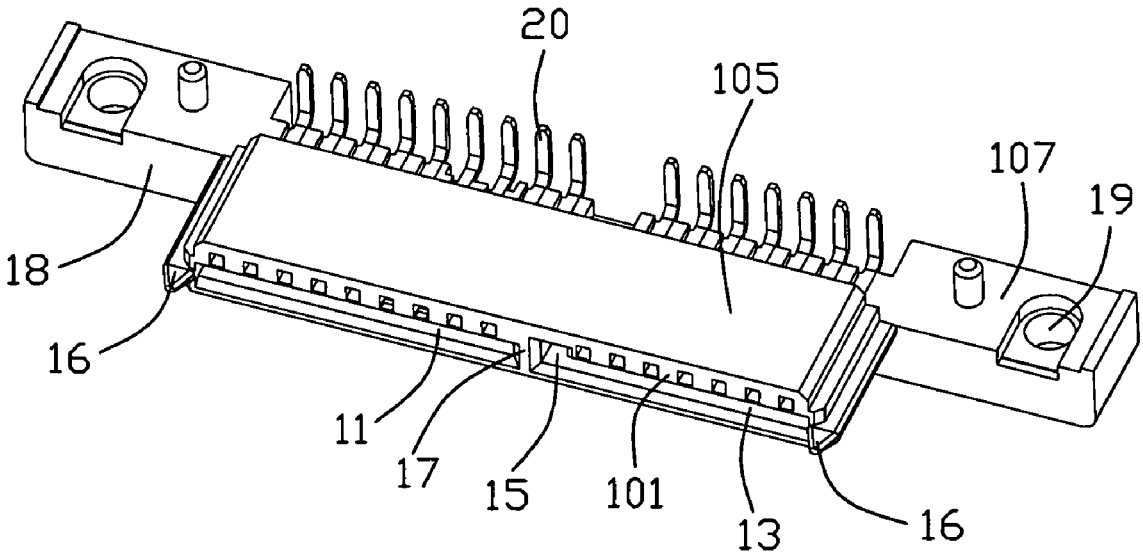
FIG. 3 is another assembled, perspective view of the electrical connector of FIG. 1, viewed from another aspect.

Referring to FIGS. 1 to 4, an electrical connector according to an embodiment of the present invention is shown to include an insulative housing 10 defining a forwardly protruding mating portion with a front face 101 and an opposite back face 103. The mating portion has first and second parts divided by a partition 17. The first part includes a first cavity 13 extending from the front face 101 toward the back face 103, and the second part includes a second cavity 11 also extending from the front face 101 toward the back face 103 and structurally different from the first cavity 13, such that the partition 17 has opposite sides formed asymmetrical about a cross-sectional center of the partition 17. A plurality of spaced passageways 100 is configured to extend therethrough from the front face 101 to the back face 103, and disposed along a transverse edge of each of the first and second cavities 13 and 11. The passageways 100 are adapted to communicate with the corresponding one of the first and second cavities 13 and 11. A plurality of terminals 20 is inserted into the passageways 100 in a direction from the back face 103 to the front face 101 of the mating portion.

Referring particularly to FIG. 1, the first cavity 13 is of an L-shape including a vertical alignment slot 15 disposed proximate to the partition 17, while the second cavity 11 merely includes a horizontal slot with no vertical alignment slot, which is removed to make the insulative housing 10 to have a greatly-reduced lateral dimension thereof so as to mount the insulative housing 10 onto a limited space of a printed circuit board (not shown). Meanwhile, the single-one vertical alignment slot 15 of the electrical connector is set such that the mated connectors are inhibited from engaging one another if one of them is reversed upside down relative to the other.

Figure 4:
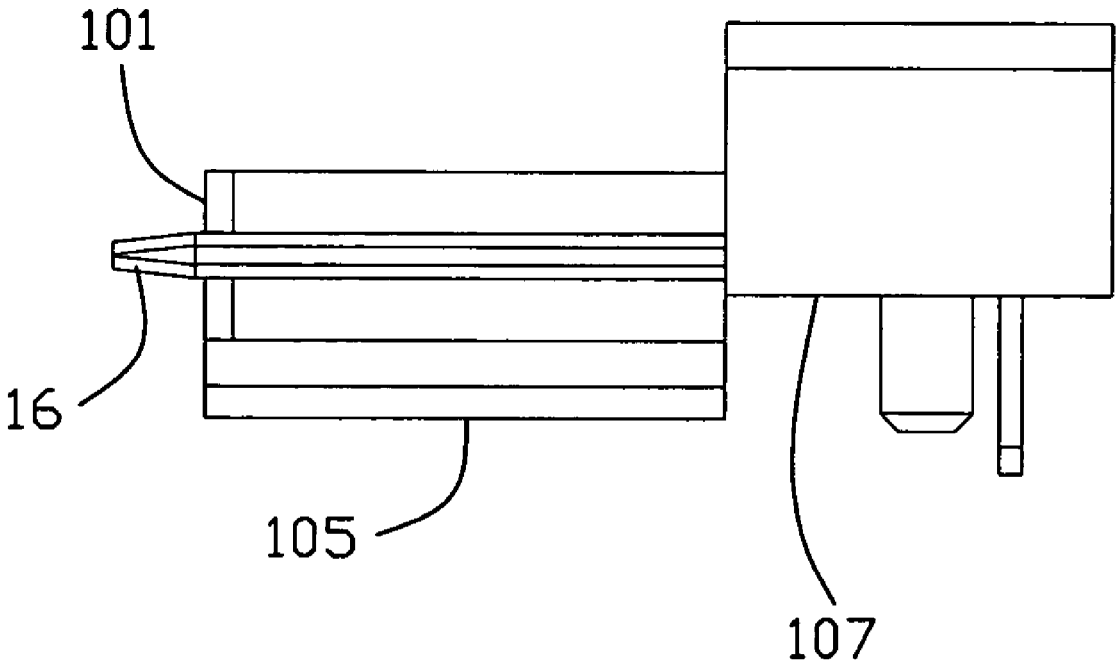
FIG. 4 is a side view of the electrical connector of FIG. 2.

Referring particularly to FIGS. 1 and 4, the insulative housing 10 further includes a pair of mounting ears 18 located at opposite sides of a back portion of the insulative housing 10, the mounting ears 10 defining a board mounting face 107 adapted to be mounted onto the printed circuit board. The mating portion also includes a bottom face 105 extending between the front face 101 and the back face 103 and locatable below the board mounting face 107 of the mounting ears 10. In addition, each of mounting ears 18 includes a fastening member 19 including a hole defined thereon to fasten the insulative housing 10 onto the printed circuit board. A pair of positioning posts 16 is positioned at opposite sides of the mating portion, with each having a height less than one half of the height of the mating portion along a vertical direction as shown in FIG. 4.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector, comprising:

an insulative housing defining a forwardly protruding mating portion with a front face and an opposite back face, said mating portion having first and second parts divided by a partition;

the first part having a first L-shaped cavity and the second part having a second non-L-shaped cavity, both of the first and second cavities extending from the front face toward the back face;

a plurality of passageways aligned in a row and extending therethrough from the front face to the back face and disposed on a transverse edge section of a corresponding one of the first and second cavities, the passageways adapted to communicate with the corresponding one of the first and second cavities; and a plurality of terminals inserted into the passageways in a direction from the back face to the front face of the mating portion and wherein said first L-shaped cavity has a vertical section adjacently disposed at one passageway in said row, while said second non-L-shaped cavity has no vertical section adjacently disposed at one of the passageways in said row.

2. The electrical connector of claim 1, wherein the insulative housing defines a board mounting face, the mating portion having a bottom face extending between the front face and the back face, the bottom face of the mating portion locatable below the board mounting face.

3. The electrical connector of claim 2, wherein the insulative housing includes a pair of mounting ears located at opposite sides of a back portion of the insulative housing, the mounting ears having said board mounting face.

4. The electrical connector of claim 1, wherein the insulative housing includes a pair of positioning posts positioned at opposite sides of the mating portion.

5. The electrical connector of claim 1, wherein the first L-shaped cavity has said vertical section located on a first side wall of the partition, said vertical section in a vertical direction longer than a portion of the second cavity, which is located on an opposite second side wall of the partition.

6. The electrical connector of claim 4, wherein each of the positioning posts has a height less than one half of a height of the mating portion along a vertical direction.

7. An electrical connector, comprising:

an insulative housing defining a forwardly protruding mating portion with a front face and an opposite back face, said mating portion including a first cavity and a second cavity divided by a partition, each of the first and second cavity extending from the front face toward the back face;

the first cavity structurally different from the second cavity, the first cavity being of an L shape including a vertical alignment part positioned proximate to the partition, wherein a plurality of first passageways is located on a transverse edge section of the first cavity and in communication with the first cavity;

the second cavity having no vertical part occupying a transverse edge section of the second cavity where a plurality of second passageways are located, the second passageways being in communication with the second cavity;

a plurality of terminals inserted into the respective first and second passageways in a direction from the back face to the front face of the mating portion.

8. The electrical connector of claim 7, wherein the insulative housing includes a pair of positioning posts positioned at opposite sides of the mating portion.

9. The electrical connector of claim 7, wherein the insulative housing defines a board mounting face, the mating portion having a bottom face extending between the front face and the back face, the bottom face of the mating portion locatable below the board mounting face.

10. The electrical connector of claim 7, wherein the first cavity has the vertical alignment part located on a first side wall of the partition, said vertical alignment part in a vertical direction longer than a portion of the second receiving cavity, which is located on an opposite second side wall of the partition.

11. The electrical connector of claim 8, wherein each of the positioning posts has a height less than one half of a height of the mating portion along a vertical direction.

12. The electrical connector of claim 9, wherein the insulative housing includes a pair of mounting ears located at opposite sides of a back portion of the insulative housing, the mounting ears having said board mounting face.

13. An electrical connector comprising:

an insulative housing defining an elongated base with thereon a forwardly protruding mating port divided with spaced first and second receiving cavities in an asymmetrical manner in a longitudinal direction of said base;

said mating port defining an upper face essentially coplanar with that of the base, and a lower face, opposite to the upper face, being lower than that of the base;

a plurality of first and second passageways formed in the housing and essentially located below said receiving cavities;

a plurality of contacts disposed in the corresponding passageways, respectively; and a pair of spaced mounting ears unitarily formed at two opposite ends of the base and defining an upward upper surface being higher than the upper face of the mating port, and a downward lower surface being essentially coplanar with that of the base for mounting to a printed circuit board; wherein the mating port is equipped with a pair of guiding posts at two opposite longitudinal ends along said longitudinal direction, and a bottom face of each of said guiding posts is higher than the lower surface of the mounting ear and the lower face of the base; wherein each of said contacts defines a horizontal retention section with a tail extending downwardly from a rear end of the retention section, and a downwardly deflectable contacting section extending forwardly from a front end of the retention end in a downward offset manner.

14. The electrical connector as claimed in claim 13, wherein each of said mounting ears is equipped with a mounting post with thereof a distal end essentially flush with the lower face of the mating post.

15. The electrical connector as claimed in claim 13, wherein each of said contacts defines a contacting section essentially disposed in the corresponding passageway, and a retention section upwardly offset from the contacting section and located at a level adjacent to the upper face of the base.

16. The electrical connector as claimed in claim 13, wherein the mounting ear has a similar height with the mating port while being offset upwardly therefrom in a distance.

17. The electrical connector as claimed in claim 13, wherein said guiding posts are generally located at a one third height of said mating port on an upper portion of said mating port.

18. The electrical connector as claimed in claim 13, wherein the first receiving cavity formed with an L shape has a vertical alignment part located on a first side wall of a partition of the mating port, said vertical alignment part in a vertical direction longer than a portion of the second receiving cavity, which is located on an opposite second side wall of the partition.

19. The electrical connector as claimed in claim 13, wherein the first receiving cavity is formed with an L shape, and the second receiving cavity has no vertical alignment section occupying a transverse edge section of the second receiving cavity where the second passageways are located.

* * * * *